US006629625B1

(12) United States Patent
Paczkowski et al.

(10) Patent No.: US 6,629,625 B1
(45) Date of Patent: Oct. 7, 2003

(54) REFLECTOR AND ANTI-FOG FILM IN AN OPTICAL SENSOR SYSTEM

(75) Inventors: Thomas S. Paczkowski, Wildwood, MO (US); John E. Dundon, St. Louis, MO (US)

(73) Assignee: Coin Acceptors, Inc., St. Louis, MO (US)

( * ) Notice: Subject to any disclaimer, the term of this patent is extended or adjusted under 35 U.S.C. 154(b) by 58 days.

(21) Appl. No.: 10/001,534

(22) Filed: Nov. 15, 2001

Related U.S. Application Data

(60) Provisional application No. 60/252,215, filed on Nov. 21, 2000.

(51) Int. Cl.[7] ..... G07F 11/00

(52) U.S. Cl. ..... 221/2; 221/21; 250/223 R

(58) Field of Search ..... 221/2, 7, 8, 21; 250/221, 222.1, 223 R, 223 B

(56) References Cited

U.S. PATENT DOCUMENTS

| | | | | | |
|---|---|---|---|---|---|
| 3,048,263 | A | * | 8/1962 | Sacks et al. | 426/129 |
| 3,946,224 | A | * | 3/1976 | Allera et al. | 250/221 |
| 4,075,463 | A | * | 2/1978 | Yurramendi Eguizabal | 377/13 |
| 4,252,250 | A | | 2/1981 | Toth | 221/13 |
| 4,354,106 | A | * | 10/1982 | Walter | 250/239 |
| 4,359,147 | A | | 11/1982 | Levasseur | 194/1 N |
| 4,450,691 | A | * | 5/1984 | Taylor | 62/140 |
| 4,629,090 | A | * | 12/1986 | Harris et al. | 221/7 |
| 5,153,436 | A | * | 10/1992 | Apperson et al. | 250/345 |
| 5,403,746 | A | * | 4/1995 | Bentsen et al. | 436/88 |
| 5,476,682 | A | * | 12/1995 | Evans | 427/164 |
| 5,496,996 | A | * | 3/1996 | Barnes et al. | 250/223 B |
| 5,522,310 | A | | 6/1996 | Black, Sr. et al. | 99/357 |
| 5,766,772 | A | | 6/1998 | Ciocca et al. | 428/516 |
| 5,927,539 | A | | 7/1999 | Truitt et al. | 221/2 |
| 6,044,843 | A | * | 4/2000 | O'Neil et al. | 128/204.23 |
| 6,095,986 | A | * | 8/2000 | Braig et al. | 600/532 |
| 6,131,399 | A | * | 10/2000 | Hall | 62/127 |
| 6,190,327 | B1 | * | 2/2001 | Isaacson et al. | 600/529 |
| 6,218,665 | B1 | * | 4/2001 | Yamamori et al. | 250/343 |
| 6,258,040 | B1 | * | 7/2001 | Yamamori et al. | 600/529 |
| 6,360,140 | B1 | * | 3/2002 | Vidondo | 700/236 |
| 6,384,402 | B1 | * | 5/2002 | Hair et al. | 250/223 R |

FOREIGN PATENT DOCUMENTS

| | | | | |
|---|---|---|---|---|
| JP | 2001067564 A | * | 3/2001 | G08B/17/103 |

* cited by examiner

*Primary Examiner*—Donald P. Walsh
*Assistant Examiner*—Daniel K Schlak
(74) *Attorney, Agent, or Firm*—Polster, Lieder, Woodruff & Lucchesi, L.C.

(57) ABSTRACT

A dispensed product detection system and method for use in a refrigerated vending machine utilizing an optical light beam crossing the path through which a dispensed product travels. An optical emitter transmits a light beam through at least one layer of substantially transparent anti-fog film to reduce moisture condensation and across the product path to an optical detector wherein signal intensity is measured. As a dispensed product passes through the light beam between the emitter and the detector, the beam is momentarily broken, resulting in a change in signal intensity at the infrared detector which is registered as the vend of a product.

14 Claims, 5 Drawing Sheets

REFLECTOR AND ANTI-FOG FILM IN AN OPTICAL SENSOR SYSTEM

CROSS-REFERENCE TO RELATED APPLICATIONS

This application is based upon U.S. Provisional Patent Application Ser. No. 60/252,215, filed Nov. 21, 2000, and claims priority there from.

STATEMENT REGARDING FEDERALLY SPONSORED RESEARCH

Not Applicable.

BACKGROUND OF THE INVENTION

The present invention relates generally to an apparatus and method for the detection of the dispensing of a product from a vending machine, and in particular to, a fog-resistant optical detection system utilizing an infrared beam transmitted from an emitter, to a reflector, and back to a detector, the path of which is broken by a product as it is dispensed from the vending machine, thereby generating a detectable signal.

Traditionally, vending machines for canned or packaged goods include a sensing mechanism designed to detect the impact of a dispensed product or package deposited in a chute or bin, such as is shown in U.S. Pat. No. 5,927,539 to Truitt et al. for a modular vending machine with a dispensing detection device. Turning to FIGS. 1–3, a typical vending machine 10 is shown employing within a cabinet 11 a traditional dispensing detection device 12, of the '539 Truitt et al. patent. The detection device 12 provides a receiving trough 14 that is defined by a number of detector plates 16 for downwardly directing a dispensed product to a receiving plate 18. In particular, each detector plate 16 includes a chute plate 20 which is opposed by a corresponding substantially parallel cover plate 22. The cover plate provides the support surface for a dispensed product as it is transferred from the storage columns 17 onto the receiving plate 18. In order to sense whether a dispensed product has passed over at least one of the detector plates 16, a membrane switch 24 and a force director 26 are disposed between the chute plate 20 and the cover plate 22. When the dispensed product passes over the force director 26, the membrane switch 24 closes, completing a circuit that registers that a product has in fact been dispensed.

These traditional impact sensors are sensitive to the impact of the falling product in terms of whether there is a soft or hard impact, with hard impacts being easier to detect. Lightweight products which result in soft impacts having lower forces are difficult to detect, and accordingly, traditional impact sensors must be capable of sensing impacts varying over a wide range of forces, often with a reduction in reliability for detecting the impact of lightweight products. In the event the dispensing of a lightweight product is not properly detected by a traditional impact sensor, the vending machine is likely to dispense a second product, or to "double-vend", resulting in an error condition requiring a service person or route manager to take corrective action.

A further drawback with traditional impact detection systems arises where products are stored, and dispensed in "triple deep" vending machines, as are commonly utilized with refrigerated canned products. Specifically, the time between the dispensing of a canned good from a first column and a second column of goods, or between a second column of goods and a third column is very small. A traditional impact sensor must be capable of registering the fall of the dispensed product rapidly, so as to immediately stop the vending machine drive motor from dispensing a product from the second or third columns of goods. Impact sensors capable of operating with the required speed and accuracy are difficult and costly to manufacture.

Alternative types of sensors to register the vending or dispensing of a product, such as photoelectric sensors, magnetic sensors, piezo-electric sensors, and optical or acoustic sensors are known, such as are disclosed in U.S. Pat. No. 4,359,147 to Levasseur and in U.S. Pat. No. 4,252,250 to Toth. However, an additional consideration when designing sensors for use in refrigerated product vending machines is the exposure of the sensors to moisture caused by condensation within the vending machine itself. Such exposure to moisture and condensation can interfere with the operation of specific types of sensors, in particular, optical sensors which rely on the detection of emitted beams of light to detect the presence or absence of a product.

Accordingly, there is a need in the vending machine industry for a low cost, highly accurate optical sensor capable of quickly registering the dispensing of a product, which is particularly suited for use in vending machines configured to dispense canned and refrigerated products wherein moisture and water vapor condensation may be present.

BRIEF SUMMARY OF THE INVENTION

Briefly stated, the preferred embodiment of the present invention is a dispensed product detection system and method utilizing an optical beam crossing the path through which a dispensed product travels. A light emitter transmits a light beam across the product path to a low-loss reflector tolerant of beam misalignment, where the beam is reflected back to an optical detector located adjacent the emitter. As a dispensed product passes through the light beam between the emitter and the detector, the beam is momentarily broken, resulting in a change in signal intensity observed by the optical detector. The emitter, detector, and reflector are each configured with an anti-fog film transparent to the optical wavelengths utilized by the emitter and detector, to prevent water condensation thereon, and to prevent any associated signal loss or degradation.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

The term "substantially" as used herein is understood to mean "within a predetermined range or tolerance", and is not limited to an exact amount or value. The term "light" as used generically herein in is understood to mean emissions in the optical spectrum, including, but not limited to, infrared, visible, and ultraviolet wavelengths. The term "infrared light" as used herein is understood to refer to light having wavelengths within the infrared spectrum. The term "optical pathway" as used herein is understood to refer to the route over which a light beam travels from an emitter to a detector, which may include interaction with any number of optical components.

Figure 4:
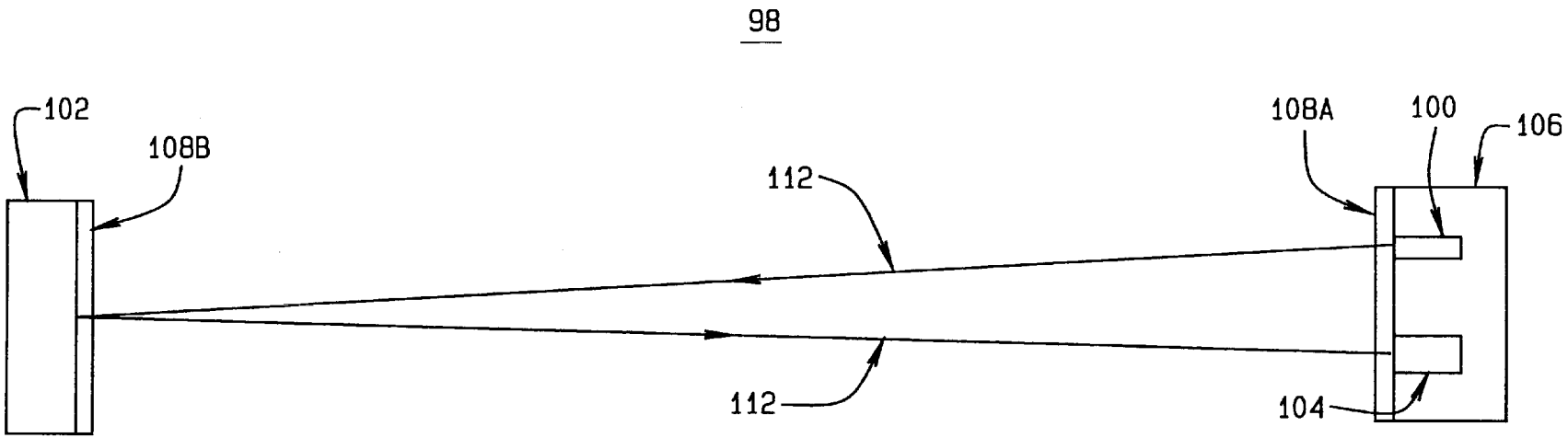
FIG. 4 is a simplified schematic view of the dispensing detection system of the present invention, specifically illustrating the placement of the anti-fog film layers at the emitter/receiver and at the reflector assemblies.

Turning to FIG. 4, the main components of the preferred embodiment of the optical sensor system 98 of the present invention are an optical beam emitter 100, an optical reflector 102 positioned opposite the emitter 100, and an optical beam detector 104 positioned adjacent the optical beam emitter 100, preferably in the same sensor housing 106. A first layer of anti-fog film 108A is positioned over both the emitter and reflector, and a second layer of anti-fog film 108B is positioned over the reflecting surface 110 of the reflector 102. Anti-fog film layers 108A and 108B are substantially transparent to the optical wavelengths emitted by the optical beam emitter 100. The anti-fog film layers 108A and 108B prevent fogging under a wide range of temperature and humidity conditions on the surfaces of the optical components due to water vapor condensation in the refrigerated environment of the vending machine 10 by spreading any water droplets which may form on the optical components, thereby preventing the formation of water beads which appear as a fog. Preferably Vistex 200 Fog-Free films are employed as film layers 108A and 108B, however, any suitable anti-fog film having the desired optical properties, such as is disclosed in U.S. Pat. No. 5,766,772 to Ciocca et al. may be utilized.

During operation of the preferred embodiment, the optical beam emitter 100 emits a light beam 112 having a predetermined intensity along an optical pathway through the first layer of anti-fog film 108A, to the reflecting surface 110 of the reflector 102 through the second layer of anti-fog film 108B. Preferably, the light beam 112 is a constant beam, however, those of ordinary skill in the art will recognize that intermittent or pulsed beams may be utilized within the scope of the invention.

Reflector 102 is tolerant of a small degree of misalignment between the optical emitter and optical detector without any significant resulting reduction or loss of signal intensity. The reflector 102 further has a reflectivity of substantially 1.0 in the optical spectrum of the light beam 112, resulting in substantially complete reflection of the light beam 112 without significant reduction in signal intensity. An example of a suitable reflector 102 is a BRT-5S round, snap-in reflector, which is mounted on a plastic backing.

After reflecting off the reflecting surface 110 of the reflector 102, the light beam 112 passes back through the second layer of anti-fog film 108B towards the optical beam detector 104, where it again passes through the first anti-fog film layer 108A and is detected by the optical beam detector 104.

Figure 1:
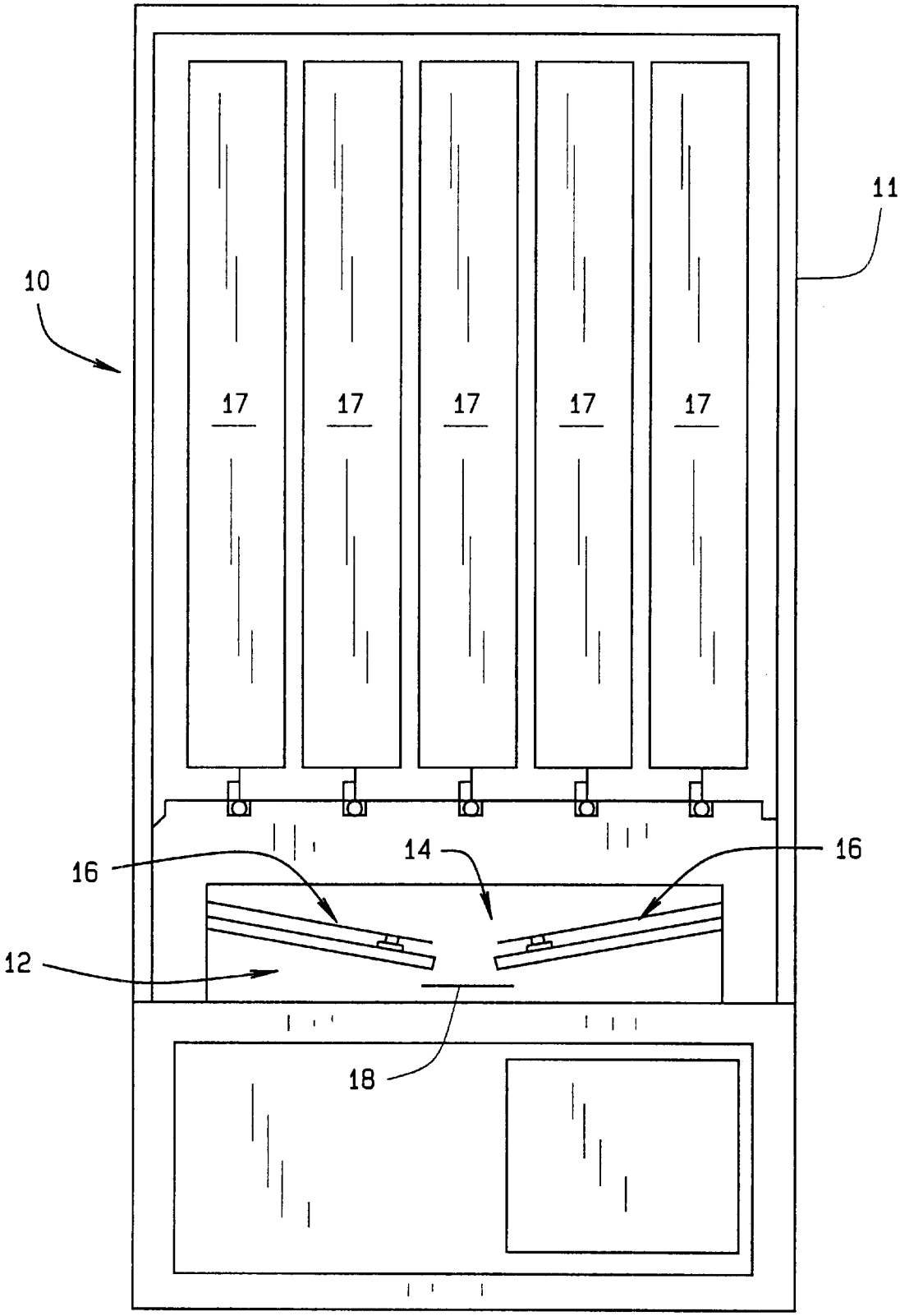
FIG. 1 PRIOR ART
FIG. 1 is an illustrative front elevational view of a prior art vending machine cabinet with the door removed and specifically illustrating a traditional dispensing detection system.
Figure 2:
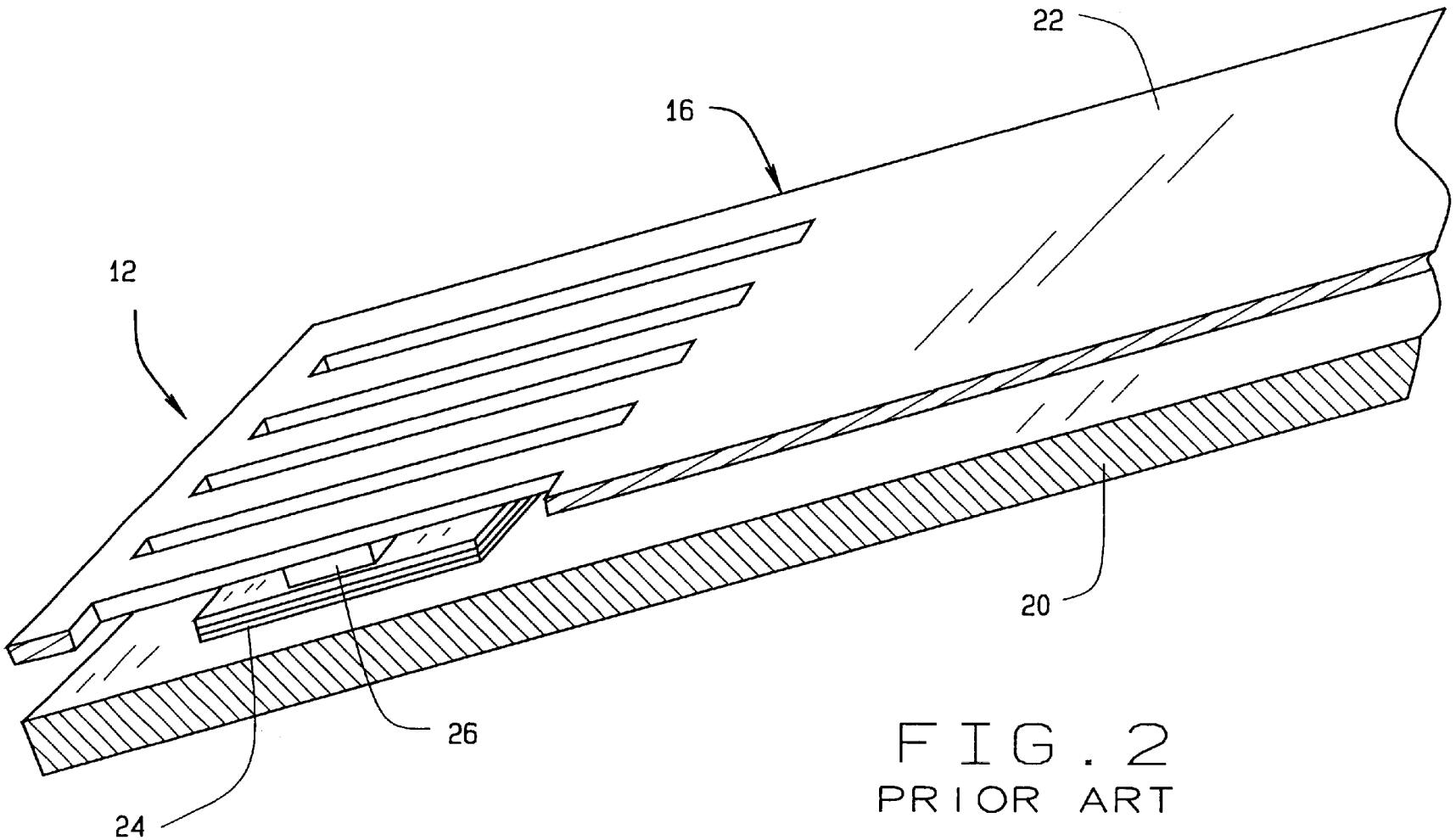
FIG. 2 PRIOR ART
FIG. 2 is a perspective view in partial cross-section of the prior art dispensing detection system shown in FIG. 1.
Figure 3:
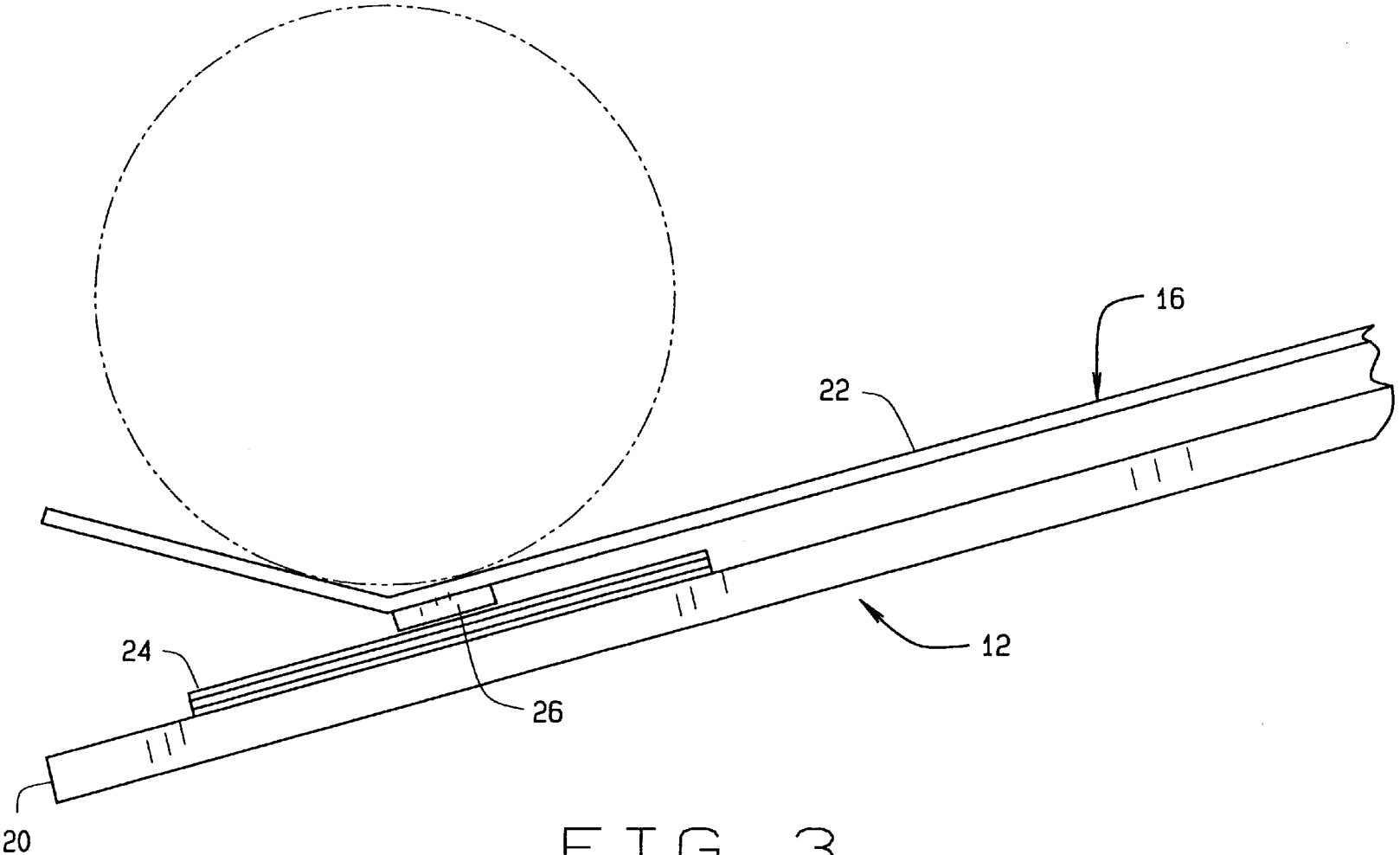
FIG. 3 PRIOR ART
FIG. 3 is a side elevational view in partial cross-section of an alternative prior art dispensing detection system for use with the vending machine shown in FIG. 1.
Figure 5:
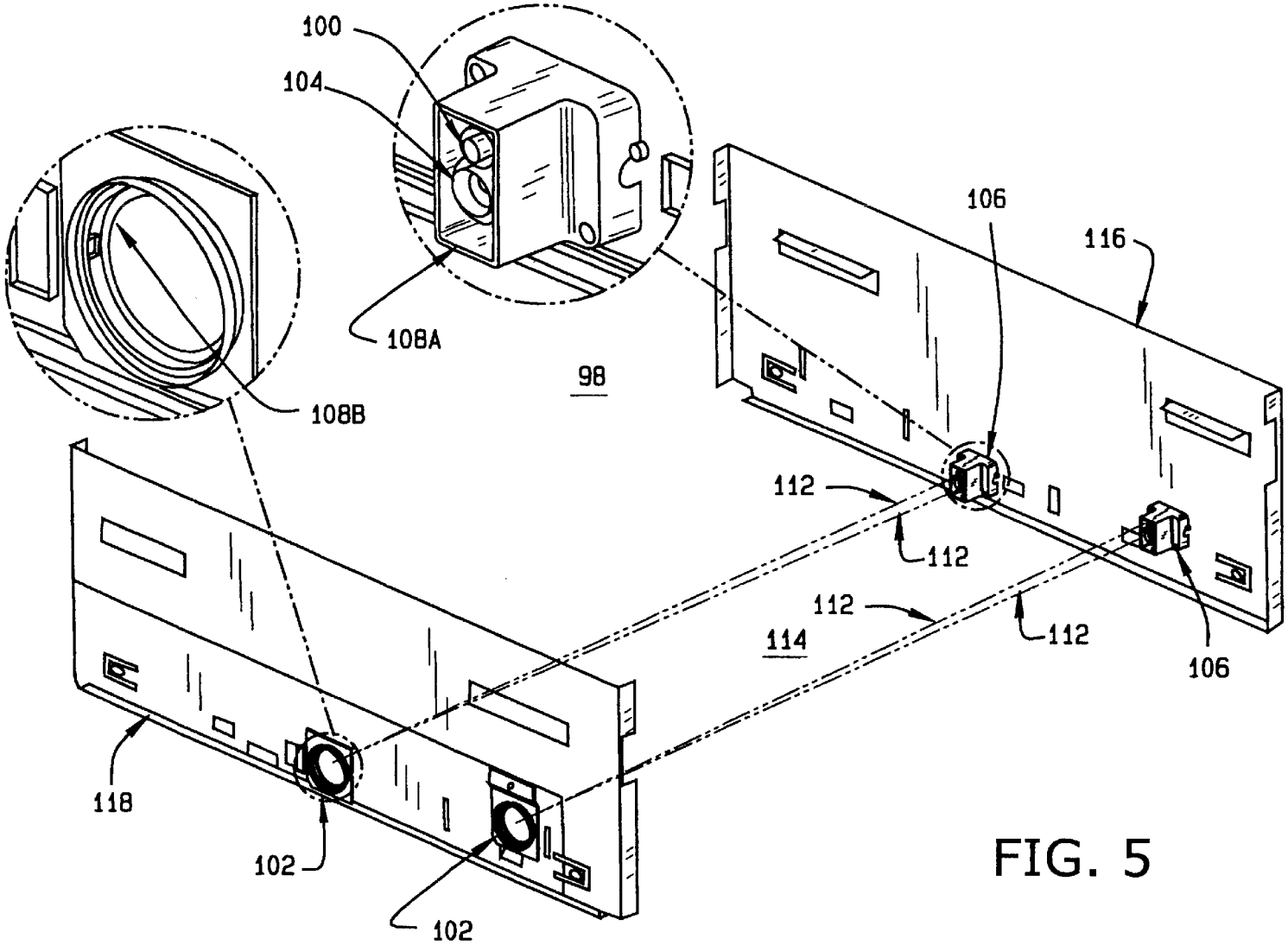
FIG. 5 is a perspective view of the dispensing detection system of FIG. 4, illustrating the placement of the components within a vending machine cabinet.

As best seen in FIG. 5, in the preferred embodiment, the optical sensor system 98 of the present invention includes two sets of emitters, reflectors, and detectors which are disposed within a product vending machine, such as vending machine 10 having storage columns 17 shown in FIG. 1, such that a dispensed or vended product must travel along a path 114 which will intersect at least one of the beams 112 of light between the optical beam emitters 100 and the optical beam detectors 104.

As a product is dispensed from the vending machine storage columns 17, it breaks one of the light beams 112 between the optical beam emitters 100 on the right side 116 of the path 114, optical reflectors 102 on the left side 118 of the path 114, and the optical beam detectors 104, resulting in a change in the intensity of the light beam 112 detected at the associated optical beam detector 104. This immediate decrease in the detected beam intensity level is the determining criteria for sensing the vending of a product from the vending machine storage columns 17. Electrical signals from the optical beam detector 104 are then routed to a vending machine control unit, or are directly utilized to signal the product vending mechanism that a single product has been dispensed, thereby preventing double vending of a product due to a delay in registering the actual release of a product from the storage columns 17. An additional benefit of the optical sensor system 98 of the present invention is the elimination of a need to differentiate between the hard and soft impact forces associated with different type of dispensed products. By properly positioning the optical sensor system 98 such that any dispensed product must break the light beam 112, product vending is detected independent of the force with which the product was dispensed.

Of importance in the design of the optical vending machine product vend detection system 98 of the present invention is the utilization of optical components such as the optical reflector 102 and anti-fog films 108 which will not result in a significant reduction in the intensity of the light beam 112, and which aid in the prevention of errors associated with misalignment of the optical components and water vapor condensation commonly found in refrigerated vending machines.

As an alternative embodiment, the optical reflector 102 may be omitted, and the optical detector 104 positioned opposite the optical emitter 100, such that the beam of light 112 travels directly across the product vend path 114 without reflection.

As a second alternative embodiment, the anti-fog film 108A may be omitted from one or more of the optical components, for example, if it is found that the optical emitter 100 remains sufficiently warm as to prevent condensation thereon without the need for the anti-fog film 108A.

Those of ordinary skill in the art will readily recognize that the vending machine product vend detection system of the present invention is not limited to use with systems employing optical beams in a specific range of wavelengths, such as the infrared wavelength range of the light spectrum, but may be utilized with light beams 112 in a wide range of optical wavelengths by providing suitable emitters, detectors, anti-fog films, and reflecting components configured for use in the selected or predetermined wavelength ranges. Furthermore, the specific geometric configuration described above in connection with the preferred embodiment may be modified to provide different coverage over the product vend path, such that the optical beam emitter 100 and optical beam detector 104 may be displaced apart from one another, and contained within separate sensor housings 106, each with its own layer of anti-fog film 108. Alternatively, multiple sets of emitters, reflectors, and detectors of the present invention may be employed, and are particularly suited where the vending machine 10 dispenses product along one of several possible vending pathways.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A vending machine for dispensing products on demand, having at least one product delivery path and an optical product delivery sensing system including at least one optical beam emitter configured to emit a beam of light within a wavelength range and at an intensity along an optical pathway for detection by at least one associated optical detector, said at least one optical beam emitter and associated optical beam detector positioned to detect the passage of a product along the product delivery path by interruption of the emitted beam of light, an improvement comprising:

at least one layer of anti-fog film disposed between the optical beam emitter and the optical beam detector such that said emitted beam of light passes through said at least one layer of anti-fog film.

2. The vending machine of claim 1 wherein said at least one layer of anti-fog film is disposed over said at least one optical beam emitter.

3. The vending machine of claim 1 wherein said vending machine further comprises at least one associated optical reflector disposed between said emitter and said detector and wherein said at least one layer of anti-fog film is disposed over said at least one optical reflector.

4. The vending machine of claim 3 wherein said optical reflector has a reflectivity of substantially 1.0.

5. The vending machine of claim 3 wherein two sets of emitters, reflectors, and detectors are provided.

6. The vending machine of claim 1 wherein said at least one layer of anti-fog film is disposed over said at least one associated optical detector.

7. The vending machine of claim 1 wherein the improvement further comprises a sensor housing, said at least one optical beam emitter and said at least one associated optical detector disposed within said sensor housing, said at least one layer of anti-fog film disposed over said at least one optical beam emitter and said at least one associated optical detector.

8. The vending machine of claim 1 wherein said at least one layer of anti-fog film is substantially transparent to light within a predetermined wavelength range.

9. The vending machine of claim 1 wherein said vending machine is configured to dispense refrigerated products.

10. The vending machine of claim 1 wherein said beam of light is an infrared beam of light.

11. The vending machine of claim 1 wherein said vending machine is a triple-depth vendor.

12. A method for detecting the vend of a product in a refrigerated product vending machine comprising the steps of:

emitting across a vend path for said product, a beam of light within a predetermined wavelength range and having a predetermined intensity from at least one optical emitter;

penetrating, with said beam of light, at least one layer of anti-fog film transparent to light in said predetermined wavelength range;

detecting said beam of light at an at least one associated optical detector; and responsive to a variation in the intensity of said detected beam of light at said at least one associated optical detector resulting from the passage of said product along said vend path, registering the vend of a product.

13. The method of claim 12 for detecting the vend of a product further comprising the step of reflecting said emitted beam of light from an optical reflector prior to detection at said at least one associated optical detector.

14. A method for detecting the vend of a product in a refrigerated product vending machine comprising the steps of:

configuring at least one optical pathway between an optical emitter and an optical detector to intersect a product vend pathway within said product vending machine;

emitting along said optical pathway, a beam of light within a predetermined wavelength range from said optical emitter, said beam of light having a predetermined intensity level;

penetrating, with said beam of light, at least one layer of anti-fog film transparent to light in said predetermined wavelength range disposed on said at least one optical pathway;

observing an intensity level of said beam of light at said optical detector; and responsive to a differential between said observed intensity level and said predetermined intensity level resulting from the passage of said product along said product vend pathway, registering the vend of said product.

* * * * *